United States Patent [19]

Feldstein

[11] 4,087,586

[45] May 2, 1978

[54] ELECTROLESS METAL DEPOSITION AND ARTICLE

[76] Inventor: Nathan Feldstein, c/o Surface Technology, Inc., Box 2027, Princeton, N.J. 08540

[21] Appl. No.: 645,198

[22] Filed: Dec. 29, 1975

[51] Int. Cl.[2] ..... C23C 3/02

[52] U.S. Cl. ..... 428/457; 428/462; 428/539; 106/1.11; 427/304; 427/306; 427/337; 427/343

[58] Field of Search ..... 427/304, 305, 306, 337, 427/343; 428/539, 457, 462; 106/1.11

[56] References Cited

U.S. PATENT DOCUMENTS

| | | | |
|---|---|---|---|
| 3,011,920 | 12/1961 | Shipley | 427/304 |
| 3,772,056 | 11/1973 | Polichette et al. | 427/54 |
| 3,793,072 | 2/1974 | Lando | 427/98 |
| 3,958,048 | 5/1976 | Donovan | 427/304 |
| 3,993,799 | 11/1976 | Feldstein | 427/306 |

*Primary Examiner*—Ralph S. Kendall
*Attorney, Agent, or Firm*—Joel F. Spivak

[57] ABSTRACT

Catalysts for activating dielectric substrates preparatory to electroless metal deposition are prepared by admixing a soluble metal salt of a non-precious catalytic metal with a secondary compound which causes the formation of a colloidal dispersion and an extraneous colloid stabilizer. The substrates are immersed in the colloidal dispersion, rinsed, activated, rinsed, and then immersed in an electroless plating bath.

18 Claims, No Drawings

ELECTROLESS METAL DEPOSITION AND ARTICLE

BACKGROUND OF THE INVENTION

In the plating of dielectric substrates by chemical (electroless) plating it is well known that suitable catalytic pretreatment is a prerequisite for effective electroless metal deposition. Such practices are well known and accepted in the art.

In examining the prior art for catalytic pretreatment it appears that while different procedures have been used, the incorporation of precious metals (e.g. palladium containing solutions) was common to all procedures. One catalytic system of particular interest is the two step process as disclosed in U.S. Pat. No. 3,011,920. In that process, a colloidal solution composed of tin (II) and precious metal salts, generally with hydrochloric acid, is used. The effective catalyst is proposed to be a colloid of an elemental precious metal (e.g. palladium) stabilized by the excess stannous chloride present in the media. While the system disclosed in U.S. Pat. No. 3,011,920 has been quite popular in commercial practices, rising costs of precious metals and miscellaneous product reliability problems has led to the quest for new systems in which the use of precious metals, tin, as well as of the hydrochloric acid would be completely eliminated.

In meeting this objective it was found, as described in U.S. Ser. No. 607,506 now U.S. 3,993,799, filed by the applicant herein, that colloidal systems based upon non-precious metals could constitute the basis for new commercial plating processes. More specifically, it was found that colloidal hydrous-oxides of non-precious metals (preferably selected from the group consisting of copper, cobalt and nickel) may be used in the direct replacement of the tin/palladium colloid followed by a treatment in a suitable reducing media. In the reducing media, reduction of the cationic portion of adduct derived through the adsorption from the colloidal media takes place, resulting in nucleating sites capable of initiation of the electroless process.

Another system utilizing non-precious metal ions is described in U.S. Pat. Nos. 3,772,056 and 3,772,078 to Polichette et al. In the systems described therein, the dielectric substrate to be plated is immersed in a solution of non-precious metal ions, and then dried to promote adherence of the ions to the dielectric surface. The retained ions may then be reduced to the metallic state by heat or chemical means. A system of this nature is a significant departure from the standard commercial process as a result of the required intermediate drying step to achieve the required adhesion. In standard commercial processes, the article to be plated is passed from one aqueous treating tank to another with intermediate rinsing steps to remove excessive material and hence minimize cross-contamination. A procedure of this nature is essential due to the automation of most plating operations and thus the Polichette et al procedure would require a major modification in standard equipment and procedures, thus rendering the process unattractive and costly. A process for electroless plating, to be commercially feasible, should be adaptable to existing commercial processing techniques.

The catalytic compositions described herein are compatible with existing commercial processing tecnhiques and apparatus and also eliminate the necessity of precious metals, tin and acid.

SUMMARY OF THE INVENTION

The catalytic colloidal compositions embodied in this invention are utilized in the electroless plating process which comprises the steps of treating a dielectric substrate with an active catalytic colloidal composition and then, when necessary, to further treat the substrate with a reducing or activating composition to provide a more active catalytic nuclei on the substrate, then contacting the substrate with an electroless plating bath.

The catalytic compositions of this invention comprise a colloidal dispersion of an inorganic salt which is insoluble or sparingly soluble in the dispersing media and which contains metallic cations of non-precious metals which lead to the formation of the catalytic sites for electroless plating of the dielectric substrate. The secondary compound comprises an anion(s) which imparts the insolubility to the metallic salts. This approach is especially useful in providing means for the control of particle size, shape, and charge on colloids. This freedom is especially significant in providing dispersions of varied catalytic properties.

The following references are just a few describing methods by which colloidal dispersions of metal colloids are prepared and characterized.

1. R. Dechak et al, J. Colloid & Interface Science, 31, No. 2, p. 257 (1969).
2. E. Matijevic et al, J. Colloid & Interface Science, 36, No. 2, p. 273 (1971).

"Catalytic agent" as used herein is intended to encompass the derivative of the cationic portion of the inorganic compounds comprising the inorganic colloidal dispersion after activation of the substrate surface. This catalytic agent provides the catalytic sites for the initiation of the electroless plating process. It is recognized that the mechanism of initiation of electroless plating vary with the nature of the catalytic agent and with the electroless plating bath(s) used. For example, the initiation mechanism is different for electroless copper (formaldehyde based) plating in the presence of iron, cuprous or copper on the substrate surface prior to the electroless initiation. This invention is thus not limited with respect to the initiation mechanism between the catalytic surface and the electroless plating formulations and as such various non-precious (non-nobel) metal derivatives may be used, of which copper, cobalt and nickel are preferred.

DETAILED DESCRIPTION OF THE INVENTION

The process of the present invention is applicable to the metallic plating of a wide variety of dielectric substrates, including thermoplastic and thermosetting resins. Normally, these substrates are etched, e.g., by treatment with a solution of chromium oxide and sulfuric acid or by 'dry' processes as known in the art, prior to plating in order to improve adhesion of the metallic coating. Following the pre-treatment the substrate is contacted with a catalytic inorganic colloidal dispersion in accordance with the present invention.

The term "Inorganic colloidal dispersion" as used herein is intended to encompass dispersions comprising inorganic compounds and mixtures thereof which are insoluble or sparingly soluble in the dispersing media and when contacted with the substrate to be plated catalyze the substrate for electroless plating. Such inorganic compounds are preferably selected from the group consisting of salts of cobalt, nickel, and copper, and mixtures thereof, however they are not limited to such. The dispersing media is preferably water.

A typical dispersion according to this invention may comprise an insoluble compound of either copper, cobalt or nickel (Handbook of Chemistry & Physics, 53rd Edition, B 85-87, CRC Press) for example: copper (II) acetatemetaarsenate; copper (II) orthoarsenate; copper (II) benzoate; copper (I) bromide; copper (I) carbonate; copper (II) carbonate, basic; copper (I) fluoride; copper (II) trihydroxychloride; copper (II) oleate, copper silicide; copper xanthate; nickel dimethylgloxime; nickel oxalate; nickel orthophosphate; nickel (di)phosphide; nickel silicide; nickel arsenide; nickel carbonate basic; cobalt phosphate; cobalt (di)phosphide; cobalt sulfide; cobalt sulfite; cobalt tungstate; or a mixture thereof dispersed in an aqueous media in colloidal form. The inorganic colloidal dispersion of the present inventions may be prepared by any of several procedures, but are most conveniently prepared by precipitation from a solution containing a soluble inorganic salt(s) of at least one catalytic metal ions by interaction with a secondary compound which causes the formation of the desired colloidal dispersion. Dispersion like nickel (di)phosphide may be prepared by the reaction of soluble nickel salts with hypophosphite derivatives.

The term "activation" refers to the step in the process in which the induction time for initiation of electroless plating on the catalytic sites previously formed on the surface of the substrate is reduced. The term "activator" therefore, encompasses any composition, substance or form of energy (e.g., UV light) of heat or combination thereof which results in activation of the catalytic sites.

One form of activator is a composition which reduces the valence of the cationic portion of the colloid. Typical reducing agents useful in the practice of the invention are derivitives of soluble borohydrides such as potassium borohydride and sodium borohydride. Under certain conditions, the surface product after chemical reduction with above reducing agents exhibits the characteristics of metallic borides (e.g., $Cu_2B$, $Co_2B$ and $Ni_2B$). As such, these are also part of the catalytic sites available for electroless initiation.

It should be noted that a separate activation step is not always necessary if suitable chemical components which cause activation are included in the chemical plating bath.

The term "catalytic system" when used herein is intended to encompass the complete procedure from the step of treating the substrate with the colloidal dispersion to activation with an activator and plating in an electroless plating bath with appropriate rinsing between steps The term "stabilizer" is used herein to generally describe substrates believed to be adsorbed onto the colloids thereby altering the surface charge characteristics of said colloids preventing their coagulation.

Stabilizers contemplated by the present invention include secondary colloids, polyalcohols (e.g., glycerol), surfactants and sugars which, while themselves do not serve to catalyze the dielectric substrate in this process, are believed to stabilize the active catalytic colloid.

Typical secondary colloids are gum arabic, gelatine, agar agar, starch, albumim, hemoglobin, cellulose derivatives such as carboxymethyl cellulose and hydroxypropyl cellulose, N-alkylbeta-aminopropionic acid, carboxymethyl dextran, and the like. Typical sugars include mannitol, sorbitol, dulcitol maltose, and arbinose raffinose.

"Surfactant" or "surface active agent" as used herein generally refers to substrates which are capable of lowering the surface tension of a liquid or the interfacial tension between two liquids. All such substances possess the common feature of a water-soluble (hydrophillic) group attached to an organic (hydrophobic) chain. Surfactants as used herein are also intended to encompass detergents and emulsifying agents and are commercially available.

In general, the electroless coating process of the present invention comprises contacting, e.g., by immersion, the dielectric substrate, (preferably previously etched) with the inorganic colloidal dispersion, rinsing the substrate with deionized water and then contacting the substrate with activator to form a discontinuous coating of the catalytic sites on the surface of the substrate for the initiation of the electroless process upon subsequent immersion of the substrate in an appropriate electroless plating bath.

More specifically, the improved process of the present invention is comprised of the following sequence of steps followed by electroless plating.

1. Immersing a dielectric substrate (preferably previously etched) in a solution comprising an inorganic colloidal dispersion containing a catalytic agent of a non-precious metal, preferably selected from the group consisting of copper, nickel, cobalt and mixtures thereof;

2. Rinsing the substrate with water to remove excess colloid;

3. Immersing the substrate after rinsing in a solution comprising an activator capable of activating the metallic ionic portion of the adsorbed colloid; and optionally rinsing the substrate with water prior to electroless plating.

For the sake of convenience, certain of the examples set forth hereinafter will not refer to the intermediate rinsing step. A rinsing step (step 2) is, in all instances, involved however. In specific instances, it is possible to delete steps 3 and 4 as set forth above by directly immersing the substrate, after rinsing, in an electroless plating solution containing a suitable activator.

In addition to the water employed in steps 2 and 4 of the above process, the objects of the present invention are achieved using the following system of solutions:

1. Inorganic colloidal dispersions containing catalytic agent of a non-precious metal preferably selected from the groups consisting of copper, cobalt and nickel and mixtures thereof; and 2. An aqueous solution of an activator which will activate non-precious metal ions in said colloid following adsorption of said colloid onto the substrate.

The following example is illustrative of the present invention and is not to be taken in limitation thereof:

EXAMPLE 1

This example shows the general procedure of the novel electroless plating process. ABS substrates (Monsanto PG Grey-299) were etched in a solution comprising 400 g/1 $CrO_3$, 350 g/1 $H_2SO_4$(conc.) and 0.5 g/1 surfactant FC-95 for about 5 minutes at 70° C. Thereafter the etched substrates were immersed in a colloidal catalytic primer solution for 5 minutes at room temperature. The primed substrates were then rinsed and immersed in a developer solution comprising 0.5 g/1 $NaBH_4$ in a commercial buffer media of pH 9 operating at room temperature and with immersion of 5 minutes. After development (activation) and rinsing, the substrates were immersed in an electroless copper bath operating at 44° C having the following composition:

| | |
|---|---|
| $CuSO_4 \cdot 5H_2O$ | 15 g/l |
| EDTA (40%) | 68 cc/l |
| NaOH | 9 g/l |
| NaCN | 3 ppm |
| $H_2CO$ (37%) | 22 cc/l |
| Tergitol TMN (a nonionic surfactant product of Union Carbide) | 0.2 (% wt) |

In the current example the colloidal catalytic dispersion comprised of:

| | |
|---|---|
| $Na_3PO_4$ | 0.095 M |
| $CoSO_4$ | 0.017 M |
| $Cu(NO_3)_3$ | 0.025 M |

Using the above colloidal media and the steps described, initiation of the electroless plating was noted visually between 15 to 30 seconds of immersion.

The stability of the above formulations may be improved by the addition of a suitable stabilizer(s) of the type described earlier. The incorporation of specific stabilizers for a specific process and the optimum concentration(s) is best determined by a trial approach.

EXAMPLE 2

Example 2 same as example 1, however, equimolar of sodium carbonate was used in the replacement of the phosphate salts. Good plating results were obtained using same procedure and testing approach.

In the practice of the present invention, an increase in the reactivity of the colloidal dispersion (e.g. increase of operating temperature) has been found to permit a decrease in the reactivity of the activator solutions. The latter may be modified by changes in the concentration of the activator used and/or changing the nature of the agent used. Methods for increasing colloidal reactivity may include concentration, temperature, particle size and charge modifications. The ability to use activators of lower reactivity is a significant cost savings and means for the use of less expensive activators.

It will be obvious to the skilled artisan that certain conditions normally observed in electroless coating technology should also be observed in the practice of the present invention. For example, the catalytic specie(s) present on the surface must interact with the reducing agent(s) present in the electroless plating bath. In this respect it is well known in the art that Ni-P type deposits (derived from hypophosphite containing baths) do not self initiate upon copper surfaces; however, Ni-B type deposits (derived from dimethylamine borane containing baths) do initiate on the same copper surface. The difference encountered is due to the choice of the reducing agent present. Furthermore, in choosing a specific electroless formulation, it is essential to know that none of the components present (complexing agents, pH adjuster, stabilizers, etc.) in the electroless formulation is capable of deactivating the catalytic surface either by dissolution or other mechanism and thus compatible electroless formulations should be selected.

It will be obvious upon a reading of the preceeding description that the processes of the invention are especially useful in printed circuitry fabrication encompassing fully additive methods, semiadditive methods, and substractive with through-hole metallization.

It will be further obvious to one skilled in the pertinent art that many modifications and variations may be made in the preceding description without departing from the spirit and scope of the present invention. For example, it will be apparent that mixtures of activating agents may be used in a single activator solution or may be used in successive steps. Furthermore, it is within the scope of the present invention to delete the use of a separate activator by directly immersing the catalyzed substrate in an electroless plating formulation containing one or more activators therein.

It should further be obvious to those skilled in the art that due to the larger number of colloidal dispersions that can be used in accordance with the present invention, significant improvement to product reliability is anticipated. Specifically, through the ability of the anionic component(s) of the inorganic colloidal dispersion, corrosive anions for the metal to be plated may be eliminated and instead selections of those anions not corrosive to said plated metal may be selected.

Based upon prior-art, it is recognized that it is reasonable to anticipate some retention of anionic components derived from the catalytic media. For example, in prior art catalysis, most solutions comprise chloride anions and an evidence of chloride was noted following the catalytic treatment. This point is noted, for example, in:

i. R. L. Meek, J. Electrochem. Soc., 122, 1177 (1975).
ii. C. H. deMinjer et al, ibid., 120, 1644 (1973).
iii. N. Feldstein et al, ibid., 120, 475 (1973).

Although the above investigators do not necessarily agree about the basic mechanism, it is quite obvious to those skilled in the art that the inclusion of such anions, singly or in combination with moisture and heat, may result in localized corrosion and eventually may lead to delamination between layers.

The problem of residual ionic contamination and the possibility of failure mechanism in electronic devices is well known and efforts are made in commerce to minimize and monitor their presence. T. F. Egan (Plating, 60, 350 (1973) ) described a simple experimental approach based upon conductance measurements to determine the presence of ionic residues. Similar considerations were given by H. F. Cole (Electronic Packaging & Production, p. 78, April 1975) which led to the development of the Ionograph sold by Alpha Metals Inc., Jersey City, New Jersey. This apparatus provides a means for monitoring residual ionic components within an electronic device which has undergone several chemical treating steps.

Much, of course, depends upon the morphology and the chemical make-up of the electroless metal(s) deposited onto the pretreated catalytic metal. It is further recognized that in the art of electroless plating of copper for instance, deposits of varied porosity may be obtained pending upon the composition used and the maintanance of such composition in commercial operations.

In view of the prior art consideration, it is thus highly desirable to have catalytic systems in which one may select any of several anionic species which make up the active catalytic specie. In so doing, given a specific task, one may select the best system given complete consideration to possible localized corrosion and hence insuring a final product of high reliability in the field.

I have thus recognized that having the ability to select the inorganic colloidal dispersion from dispersions having various anionic components, a major step forward is taken in meeting such an objective.

While we do not wish to be bound by theory, it is nevertheless instructive to review some of the role(s) that anionic components may play in colloidal dispersions. The following references are just a few illustrations in which model(s) and discussion(s) on the anion participation and effects are described.

1. E. Matijevic et al, J. Colloid & Interface Science, 36, No. 2, p. 273 (1971).
2. P. McFadyen et al, ibid., 44, No. 1, p. 95 (1973).
3. I. M. Vasserman et al, Russian Journal of Inorganic Chemistry, 13, p. 1041 (1968).
4. "A Short Textbook of Colloid Chemistry," p. 147–151, 2nd, Edition, B. Jirgensons and M. E. Straumanis, The Macmillan Company, N.Y. (1962).
5. "Colloid Chemistry," R. J. Hartman, Chapter 12, Houghton Mifflin Company (1939).

From these references it is apparent that the anionic component(s) do play a significant role and they are an integral part of colloid double layer structure and thus affect the electrochemical behavior of such colloids. Accordingly, the present invention, in which are a variety of colloids of various insoluble anions, provides colloids varying in the electrochemical properties. One such property is the subsequent heterogeneous electrochemical activation (reduction) which takes place in an activating step. Hence, one may try any of several based colloids and select that colloid desired, e.g., ease or interness towards chemical reduction of the metallic portion of the colloid. It is, of course, highly practical for the present invention to employ those colloids which are activated (reduced) with greater ease, thus requiring less reactive activating media and thereby decreasing the process cost while increasing its efficiency.

What I claim is:

1. An Electroless plating process comprising the steps of (a) immersing a dielectric substrate in a colloidal dispersion of insoluble or sparingly soluble compounds of a non-precious metal catalytic agent, (b) activating the colloid adsorbed on the surface whereby the induction time for the actual electroless build-up is reduced, and (c) electrolessly plating a metal on said substrate, and wherein said compounds are devoid of hydrous oxides.

2. The electroless plating process recited in claim 1 wherein said activation is by immersion in an activator selected from soluble borohydrides.

3. The electroless plating process recited in claim 1 wherein said dispersion comprises an inorganic compound of a cation selected from the group consisting of copper, cobalt and nickel.

4. The process according to claim 1 wherein steps b and c are combined.

5. An improved process for rendering dielectric substrates receptive to deposition of metals and alloys by electroless plating comprising the steps:

a. contacting said substrate with a colloidal dispersion of insoluble or sparingly soluble compounds of non-precious metal catalytic agent and wherein said compounds are devoid of hydrous oxide,
b. activating said contacted substrate to form catalytic sites of greater activity capable of electroless plating initiation.

6. The process according to claim 5 wherein said non-precious metals are selected from the group consisting of copper, cobalt, nickel, and iron.

7. The process according to claim 5 wherein activation is accomplished by contacting said substrate with a suitable reducing agent.

8. The process according to claim 5 wherein the colloid of said colloidal dispersion is negatively charged.

9. The process according to claim 5 wherein the colloid of said colloidal dispersion is positively charged.

10. The process according to claim 5 wherein said inorganic colloidal dispersion includes a stabilizer.

11. The process according to claim 5 wherein step b) is part of the electroless plating formulation.

12. An article produced by the steps comprising:

a. contacting said article with a colloidal dispersion of insoluble or sparingly soluble compounds of a non-precious metal catalytic agent for electroless plating and excluding hydrous oxides and the product resulting from admixing and interaction of borides with metal ions selected from the group consisting of copper, cobalt, nickel, iron and manganese, and
b. activating said contacted article whereby the induction time for the actual electroless build-up is reduced.

13. The article according to claim 12 wherein said non-precious metals are selected from the group consisting of copper, cobalt, nickel and iron.

14. The article according to claim 12 wherein the colloid of the dispersion is negatively charged.

15. The article according to claim 12 wherein the said inorganic colloidal dispersion further includes a colloidal stabilizer.

16. The article according to claim 15 wherein the colloidal stabilizer is a surfactant.

17. The article according to claim 12 wherein the colloid of the colloidal dispersion is positively charged.

18. The article according to claim 5 wherein step b) is part of the electroless plating formulation.

* * * * *